United States Patent [19]

Loerch

[11] Patent Number: 4,662,304

[45] Date of Patent: May 5, 1987

[54] ROWING APPARATUS

[76] Inventor: Mark P. Loerch, 161 E. Lake Blvd., Winona, Minn. 55987

[21] Appl. No.: 801,571

[22] Filed: Nov. 25, 1985

[51] Int. Cl.[4] ..... B63B 17/00

[52] U.S. Cl. ..... 114/363; 440/104; 441/75

[58] Field of Search ..... 440/104, 105, 106–110; 114/347, 363; 441/70, 75; 272/72

[56] References Cited

U.S. PATENT DOCUMENTS 4,234,990 11/1980 Colburn ..... 441/75

FOREIGN PATENT DOCUMENTS 3019514 11/1981 Fed. Rep. of Germany ..... 440/105
420637 2/1911 France ..... 114/363
2134454 8/1984 United Kingdom ..... 114/347

OTHER PUBLICATIONS

*Canoe,* Oct. 1985, pp. 68–69, Piantedosi Row Wing.
*Design News,* Nov. 1985, pp. 90–91, "Foam and Composite Grids Strengthen Rowing Shell", by Frank Yeaple.

*Primary Examiner*—Joseph F. Peters, Jr.
*Assistant Examiner*—Paul E. Salmon

[57] ABSTRACT

A lightweight portable rowing apparatus structure, which, when positioned in the lower interior portion of a watercraft's hull, is held in place by the weight of an oarsman. The rowing apparatus does not attach to the hull and may be easily removed from the watercraft. The apparatus includes an oar rigger, a captively held roller seat, a foot rest for each foot of the oarsman and a control network for simultaneously disengaging the bindings from the oarsman's feet during emergencies. The structural configuration of the rowing apparatus allows forces, when they are exerted by the feet of the oarsman, to be directly transmitted to the oar riggers.

2 Claims, 9 Drawing Figures

22
21
28
13
11
82
07
02
30
09
17
18
80
83
87
10
81
06
01
08
12
20
27
83
17
83
17

ROWING APPARATUS

BACKGROUND

This invention relates to rowing devices that rest in boat or canoe hulls and specifically to any removable apparatus, which in addition to supporting oars, enables leg movement of an oarsman to help propel a watercraft.

The following patents define structures, which would appear to be germane to the patentability of the disclosed invention.

U.S. Pat. No. 230,690; E. A. Bennett

U.S. Pat. No. 2,033,637; E. Kaiser

U.S. Pat. No. 3,898,950; Martin

The patent to E. A. Bennett illustrates the use of a foot board integral with a sliding oar rigger.

E. Kaiser teaches a method for supporting oars to a base. The base comprises a track and a movable seat. Martin further delineates the state of the art by introducing the use of an adjustable oar rigger.

In the aforementioned references where movable seats were germane to patentability, the oar supports emanated from two longitudinally extending beams. The beams, being parallel to the longitudinal axis of a watercraft, supported a seat at one end. At the other end, the beams were turned up to form a foot support.

In the present invention, oar riggers are secured directly to the upper part of the structure where the feet of an oarsman are supported. By directly securing oar riggers to the upper part of the structure, the generation of bending moments within the structure is minimized. The frame can therefore be constructed of a lightweight material without having to sacrifice strength. Furthermore, the rowing apparatus of the present invention is advantageous in that the bindings for the feet of an oarsman can be simultaneously released by a manually operated control line. Finally, the disclosed invention has the advantage of not being attached to a watercraft hull. The rowing apparatus can be easily removed from a watercraft since the frame is held to the lower interior hull surface of a watercraft by means of an oarman's weight.

SUMMARY

The purpose of this invention is to provide a rowing apparatus for steering and propelling boats, canoes and like watercraft in a safe and efficient manner. This is accomplished by means of a removable frame, which due to the weight, of the oarsman thereof, is securely held in the hull of a watercraft.

This invention has for its object a means to minimize the weight of the materials necessary for the construction of the frame. This is achieved through securing the oar riggers to the part of the frame where the oarsman's feet are supported.

Another object of this invention is to provide a control network for safely freeing the oarsman's feet during emergencies. This is accomplished with a manually operated control line that allows both bindings to be simultaneously released from the oarsman's feet. These and other objects will become apparant in the following specification when considered in light of the attached drawing.

DRAWINGS

DESCRIPTION

Figures 1, 2, 3, 4:
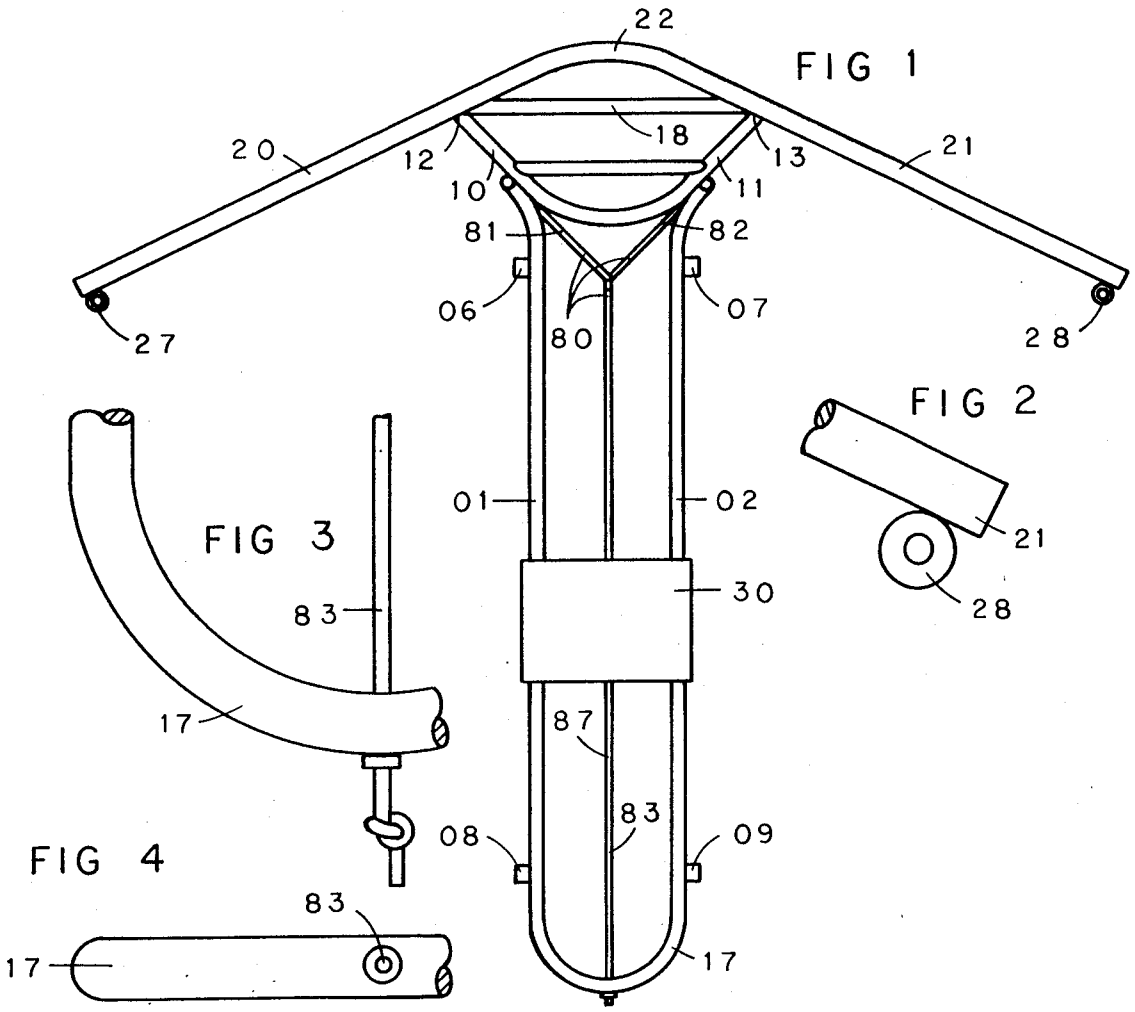
FIG. 1 is a top view of the rowing apparatus with the foot rests having been deleted in order to emphasize the structural configuration of the frame.
FIG. 2 is an enlarged top view of the oar lock receptacle from the port side of the rowing apparatus of FIG. 1.
FIG. 3 is an enlarged top view of FIG. 1 showing the portion of the frame that is located behind the seat.
FIG. 4 is an end view of FIG. 3.
Figure 5:
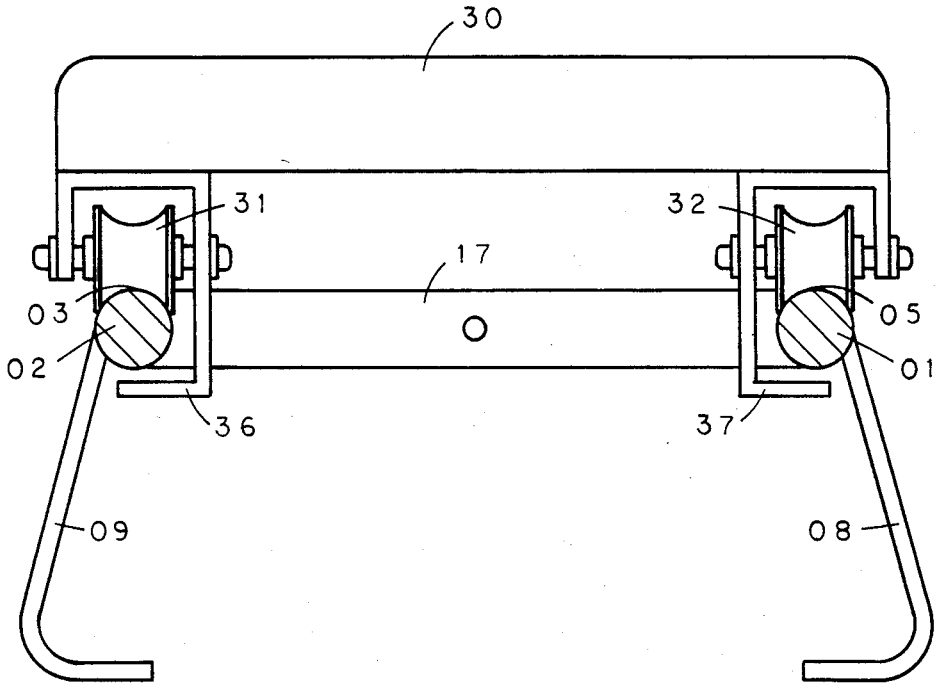
FIG. 5 is an enlarged front view of the seat of FIG. 1.
Figure 6:
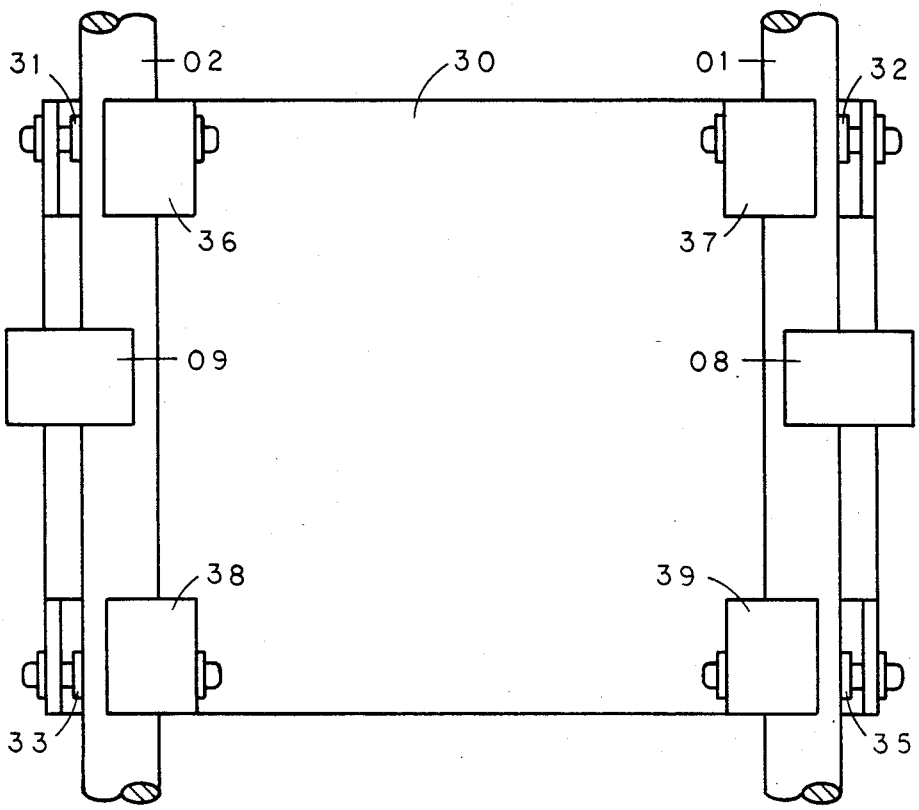
FIG. 6 is an enlarged bottom view of the seat of FIG. 1.
Figure 7:
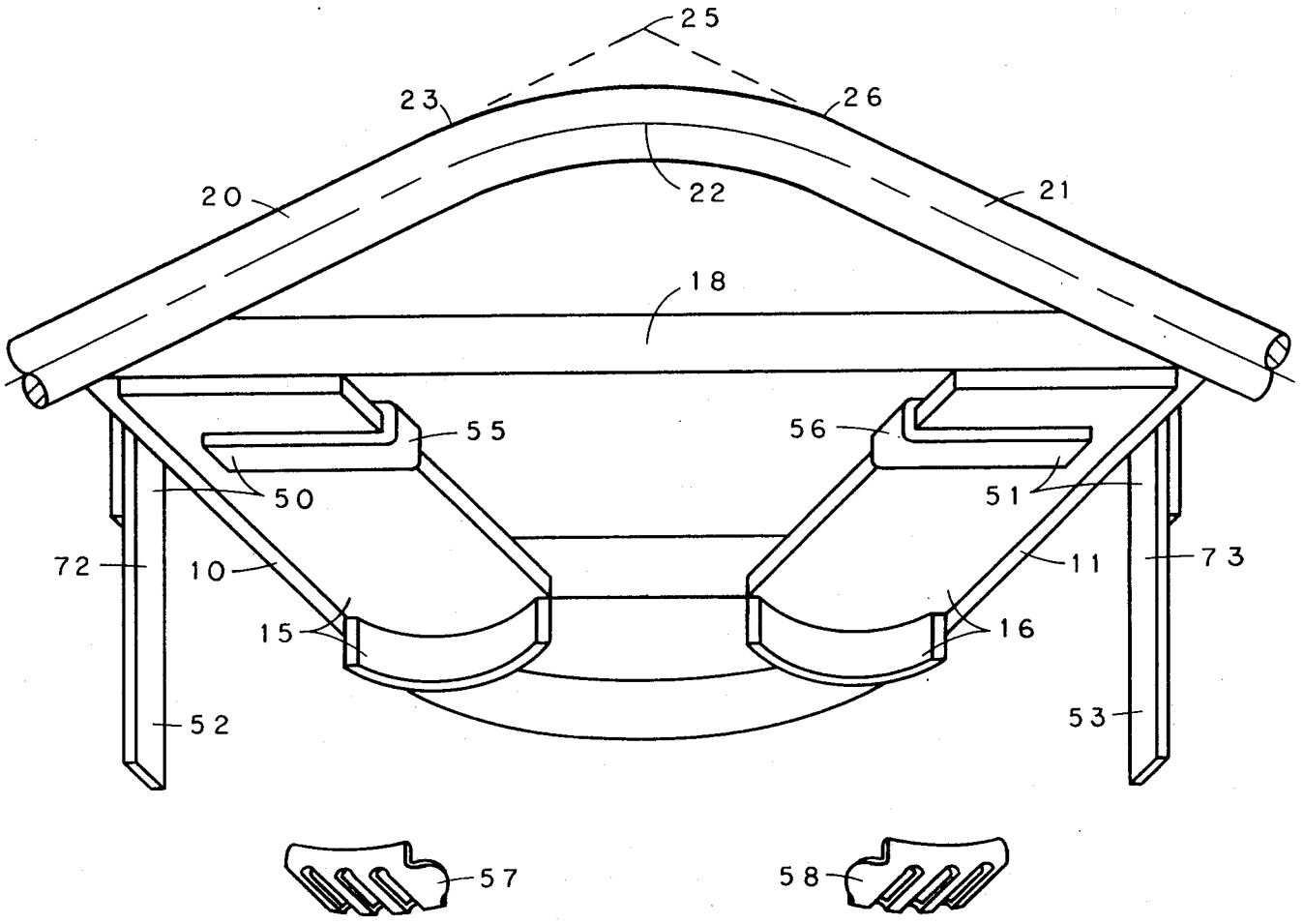
FIG. 7 is an enlarged top view of the foot rests that were deleted from FIG. 1.
Figure 8:
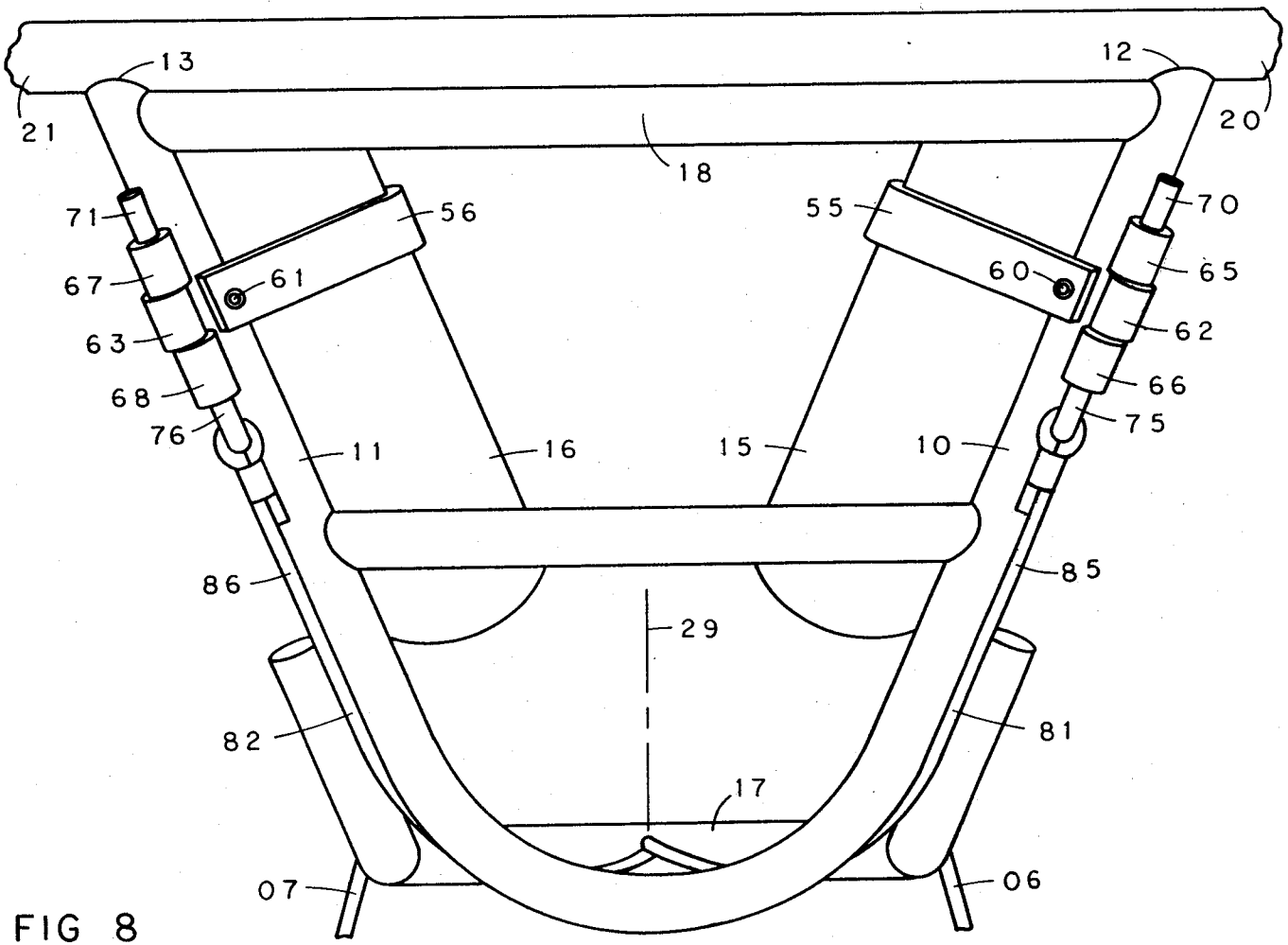
FIG. 8 is an end view of FIG. 7 showing the portion of the frame that is located in back of the foot rests.
Figure 9:
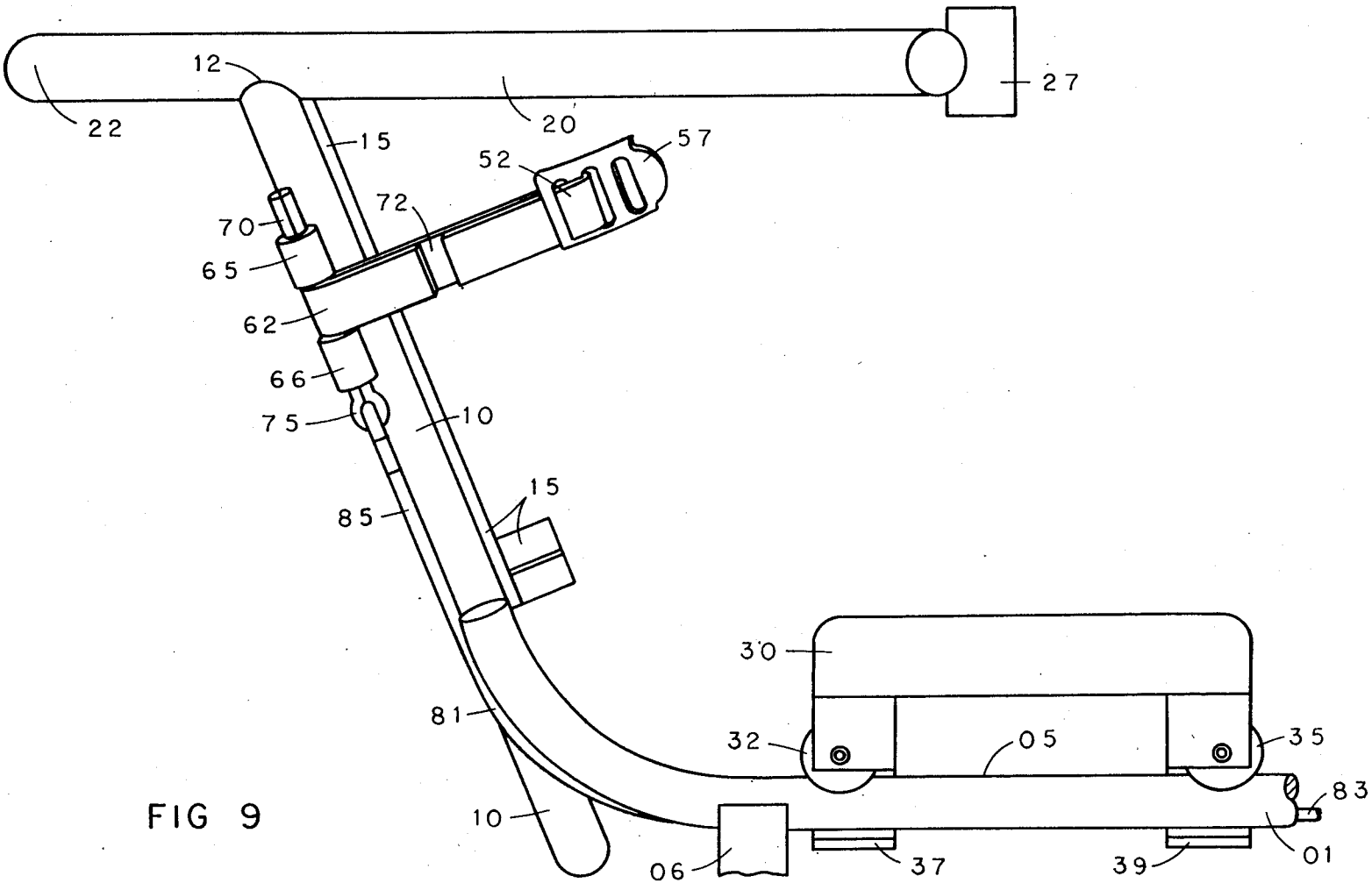
FIG. 9 is a side view of FIG. 8.

The rowing appartus is comprised of a support structure. A pair of parallel cross-connected beams 01, 02, are supported from the lower interior surface of a watercraft hull by a suitable number of legs 06, 07, 08, 09. The legs 06, 07, 08, 09, are attached near the ends of the beams 01, 02. The beams 01, 02, extending longitudinally of the watercraft, are positioned in a horizontal plane and are parallel to the longitudinal watercraft axis. The beams 01, 02, which are also tracks 03, 05, for wheels 31, 32, 33, 35, are spaced a suitable distance apart. The set of wheels 31, 32, 33, 35 that are located on the beams 01, 02, support a seat 30. The seat 30 is movable fore and aft. Extensions 36, 37, 38, 39 emanating from the bottom of the seat 30, pass beneath the beams 01, 02. Support for a pair of foot rests 15, 16 is provided by a pair foot-supporting members 10, 11. The foot-supporting members 10, 11 extend upwardly from the pair of parallel cross-connected beams 01, 02. The foot-supporting members 10, 11 are also cross-connected. The upwardly angled ends 12, 13 of the foot-supporting members 10, 11 terminate on a pair of opposing arms 20, 21. A pair of oar lock receptacles 27, 28 are supported by the opposing arms 20, 21. The opposing arms 20, 21 are connected to the upper portion of the pair of upwardly extending foot-supporting members 10, 11. The arms 20, 21 (hereafter referred to as oar riggers) emanate outwardly from a point 22 that is offset from the upper section 18 of the pair of upwardly extending foot-supporting members 10, 11. The aforementioned point 22, from which the oar riggers 20, 21 emanate, diagonally opposes the cross-connected parallel beams 01, 02. The oar riggers 20, 21 are therefore angled toward the upwardly extended vertical centerline axis 29 of the seat support structure.

The foot rests 15, 16 are integral of the upper portion of the pair of aforementioned upwardly extending foot-supporting members 10, 11. Straps 55, 56 are fastened near the foot rest 15, 16 to the upwardly extending foot-supporting members 10, 11 and form a pair of bindings 50, 51.

The present example includes a binding 50 that is comprised of a strap 52 and a buckle 57. The strap 52 is interrupted by the buckle 57. One end of the strap 55 is secured to the upwardly extending foot-supporting member at 60. The other end of the strap 52 forms a loop 62. The loop 62 is coupled between ferrules 65, 66 that are affixed to the aforementioned upwardly extending foot-supporting member 10. A removable pin 70 passes through the ferrules 65, 66, and the loop 62. The looped end of the strap 52 is connected to the upwardly extending foot-supporting member 10 by the aforementioned removable pin 70.

One branch 81 of a disengagement control network 80 is linked to one of the bindings 50 and extends downwardly along the aforementioned upwardly extending foot-supporting member 10 toward the seat 30. The second branch 82 of the aforementioned disengagement control network 80 is linked to the adjacent binding 51 and extends downwardly along the aforementioned upwardly extending foot-supporting member 11 toward the seat 30. The third branch 83 of the disengagement control network 80 is linked to the first and second branches thereof 81, 82, and passes beneath the seat 30 to link the portion of the frame 17 that is located behind the seat 30. The control lines 85, 86, 87, of which the branches of the disengagement control network 81, 82, 83, are comprised, emanate from the removable pins 75, 76 of the bindings 50, 51 and are connected to the frame 17 behind the seat 30.

OPERATION

The structural configuration of the rowing frame allows the frame to withstand the forces that are exerted on the frame during rowing and minimizes the weight of frame construction materials. The oar riggers 20, 21 emanate outwardly from a point 22 that is offset from the upper section 18 of the pair of upwardly extending foot-supporting members 10, 11. The point 22 diagonally opposes the cross-connected parallel beams 01, 02. The oar riggers 20, 21 are angled toward the upwardly extended vertical centerline axis 29 of the seat support structure. The oar riggers 20, 21 are connected near the foot rests 15, 16 of the upwardly extending foot-supporting members 10, 11 and allow the bending moments within the structure to be minimized. The stress during rowing is equally distributed across the portions of the oar riggers 20, 21 that are located across the top of the foot rests 15, 16.

The aftward forces, that are exerted by an oarsman's feet during rowing, are transmitted to the oar riggers 20, 21. The resulting stresses, which the oar riggers 20, 21 undergo, vary according to the following conditions: the force directions of the oars during rowing, the size of the angle 23, 25, 26 between the oar riggers 20, 21 and the magnitude of the distance between the points at which the oar riggers 20, 21 are supported.

The plurality of legs 06, 07, 08, 09, that extends from the parallel cross-connected beams 01, 02, supports the structure above the lower interior hull surface of a watercraft. An oarsman's weight holds the frame to the lower interior portion of the hull. The combined weight of the structure and of the aforementioned oarsman is distributed to the hull through the legs 06, 07, 08, 09. The legs 06, 07, 08, 09 concentrate loads only to the places on the hull where the legs 06, 07, 08, 09 are located. During rowing, the load concentrations of the legs 06, 07, 08, 09 on the hull prevent the frame from moving around inside the hull.

The pair of parallel cross-connected beams 01, 02 function to support the seat 30. The beams 01, 02 also serve as tracks 03, 05, and support the wheels 31, 32, 33, 35, of the seat 30. The wheels 31, 32, 33, 35 roll on the beams 01, 02 and facilitate the fore and aft movement of the seat 30 during rowing. Extensions 36, 37, 38, 39, emanating from the bottom of the seat 30, pass beneath the cross-connected parallel beams 01, 02 and capture the seat 30 to the frame. The extensions 36, 37, 38, 39, serve as guides and prevent the seat 30 from sliding off the tracks 03, 05.

The foot rests 15, 16, being integral of the upwardly extending foot-supporting members 10, 11, prevent the feet of an oarsman from twisting in clockwise and counter-clockwise directions during rowing. The straps 52, 53, 55, 56, of the bindings 50, 51, are fastened to the upwardly extending footsupporting members at 60, 61, and secure the feet of an oarsman thereto. The buckles 57, 58 that interrupt the straps 52, 53, 55, 56, allow the bindings 50, 51 to be adjusted to accommodate the oarsman's feet. The ferrules 65, 66, 67, 68, and the looped portions of the straps 62, 63 upon being aligned and coupled together, form a means for hitching the bindings 50, 51 to the upwardly-extending foot-supporting members 10, 11. The removable pins 70, 71, pass through the ferrules 65, 66, 67, 68, of the respective bindings 50, 51 and through the looped portions of the straps 62, 63 so as to connect the bindings 50, 51, to the upwardly-extending foot-supporting members 10, 11. The ferrules 65, 66, 67, 68, are affixed to the upper portions of the upwardly extending foot-supporting members 10, 11 and allow the disengagement of the aforementioned removable pins 70, 71. The disengagement of the removable pins 70, 71 from the bindings 50, 51 unhitches one side of each binding 72, 73. The looped portions of the straps 62, 63 become disconnected from the ferrules 65, 66 67, 68, and cause the straps 52, 53, 55, 56, to be released from around the oarsman's feet. The parts of the removable pins 75, 76 to which the control lines 85, 86 are linked, serve as means for disengaging the removable pins 70, 71.

When the control lines 85, 86, 87 of the disengagement control network 80 are pulled by the oarsman, the removable pins 70, 71 are simultaneously disengaged from the bindings 50, 51. The upwardly-extending foot-supporting members 10, 11 guide the control lines 85, 86 downwardly toward the seat 30. Since the third branch 83 of the disengagement control network 80 passes beneath the seat 30, the oarsman is able to manually operate the control lines 85, 86, 87 of the disengagement control network 80 at any point along the two parallel cross-connected beams 01, 02.

While the above description contains many specificities, these should not be construed as limitations on the scope of the invention, but rather as an exemplification of one preferred embodiment thereof. Many other variations are possible. For example, some of these variations include a support for the feet of an oarsman with the support being comprised of one or more upwardly extending foot-supporting members that are (is) cross-connected or linked in any suitable manner to enable the oarsman to transmit with his feet an aftward force to the oar riggers during rowing, a seat support having any suitable arrangement for the fore and aft movement of the seat, a seat having any suitable number of extensions that capture the seat to the rowing frame, a structure that comprises any suitable number of legs for concentrating loads on the lower interior hull surface of a watercraft, a disengagement control network having any number of branches and being comprised of controls of any suitable type that allow an oarsman to simultaneously release a pair of bindings during rowing. Accordingly, the scope of the invention should be determined not by the embodiment illustrated, but by the appended claims and their legal equivalents.

What is claimed is:

1. A rowing apparatus for a watercraft having means to simultaneously release a pair of bindings from an oarsman's feet comprising:

a. a seat support that extends longitudinally of a lower interior surface of the hull of said watercraft;

b. means for supporting the feet of said oarsman, with said feet-supporting means extending upwardly from said seat support and preventing the feet of said oarsman from twisting clockwise and counter-clockwise;

c. a pair of bindings;

d. means for securing said pair of bindings to said feet-supporting means;

e. means for hitching said feet-supporting means to said pair of bindings so that said feet-supporting means may be coupled to one side of each binding;

f. means for hitching said pair of bindings to said feet-supporting means so that one side of each binding may be coupled to said feet-supporting means;

g. means for connecting said hitching means of said pair of bindings to said hitching means of said feet-supporting means, with said connecting means holding said hitching means of said pair of bindings to said hitching means of said feet-supporting means;

h. means for disengaging said connecting means, with said disengaging means being integral with said connecting means, and allowing the coupled sides of said pair of bindings to be unhitched from said feet-supporting means;

i. means for controlling said disengaging means, with said controlling means allowing said disengaging means to be manually operated by said oarsman;

j. a disengagement control network, which, being comprised of said controlling means, emanates from said pair of bindings, with said disengagement control network being guided downwardly toward said seat support by means of said feet-supporting means, with a branch of said disengagement control network extending longitudinally along said seat support and linking the opposite end thereof, so that said controlling means is accessible to said oarsman for the manual operation thereof, with said controlling means enabling said oarsman to simultaneously unhitch said pair of bindings from said feet-supporting means;

2. a rowing apparatus as in claim 1, in which a seat is movable fore and aft comprising:

a. a seat;

b. means for guiding said seat, with said guiding means allowing fore and aft movement of said seat on said rowing apparatus while capturing said seat thereto.

* * * * *